United States Patent [19]

Colleran et al.

[11] Patent Number: 4,900,271

[45] Date of Patent: Feb. 13, 1990

[54] ELECTRICAL CONNECTOR FOR FUEL INJECTOR AND TERMINALS THEREFOR

[75] Inventors: Stephen A. Colleran, Lisle; Lawrence E. Geib, Bartlett; Robert J. Gugelmeyer, Aurora; Bill B. Wilson, Montgomery, all of Ill.

[73] Assignee: Molex Incorporated

[21] Appl. No.: 314,992

[22] Filed: Feb. 24, 1989

[51] Int. Cl.[4] ..... H01R 13/422

[52] U.S. Cl. ..... 439/595; 439/275; 439/856

[58] Field of Search ..... 439/586, 587, 589, 595, 439/603, 275, 856

[56] References Cited

U.S. PATENT DOCUMENTS

| | | | |
|---|---|---|---|
| 2,419,018 | 4/1947 | Gudie | 439/595 |
| 4,711,508 | 12/1987 | Soeyoshi | 439/603 |
| 4,776,813 | 10/1988 | Wilson et al. | 439/595 |
| 4,826,452 | 5/1989 | Sian | 439/595 |

*Primary Examiner*—Neil Abrams

*Attorney, Agent, or Firm*—Louis A. Hecht; Stephen Z. Weiss

[57] ABSTRACT

A connector assembly is provided for automotive fuel injectors or temperature sensors. The connector comprises an insulator housing having a plurality of locking members disposed therein for locking engagement with conductive terminals. The housing is constructed to prevent improper orientation of the terminals therein. The locking members are further constructed to prevent insertion of a second terminal until the first terminal has been properly and fully seated and locked within the insulator housing. A TPA (terminal position assurance) component can be engaged on the insulator housing prior to insertion of the terminals to define a subassembly for shipment to a final assembly location. Movement of the TPA component into a second position on the housing assures proper positioning and alignment of the terminals therein.

19 Claims, 9 Drawing Sheets

ELECTRICAL CONNECTOR FOR FUEL INJECTOR AND TERMINALS THEREFOR

BACKGROUND OF THE INVENTION

Electrical components that are mounted in the engine compartment of a vehicle are subjected to wide ranges of environmental conditions and physical abuse. In particular, electrical components in an engine compartment are subject to substantial ranges in temperature due to climatic changes and engine operating conditions. These components are exposed to soil and are frequently splashed with water, lubricants and fuels. Electrical components on a vehicle are almost continuously subjected to vibrations during use, are frequently subjected to sharp jarring movement as the vehicle traverses a rough road, and are often directly contacted by maintenance personnel working in the engine compartment.

Developers of automotive electrical components must address the various demands that are imposed upon the connector. Additionally, specifications generally limit these electrical components to a small space envelope in view of the increased crowding of electrical and mechanical components in the engine compartment of a vehicle. The electronics industry also is extremely competitive, and it is necessary for the engineer to design components at a minimum relative cost. Even small savings in size or cost can be very significant.

The electrical connectors for electronic fuel injector systems are subjected to all of the above described conditions and constraints. In particular, the connectors for fuel injectors or the temperature sensors associated with fuel injectors are mounted very close to the engine, and therefore are subjected to particularly broad ranges of temperature variation and vibration. Electrical connectors in the vicinity of fuel injectors are particularly susceptible to frequent splashing by water, lubricants or fuel. Furthermore, the electrical connectors for fuel injectors and/or their temperature sensors are typically in locations where they will be contacted by maintenance personnel working on the vehicle. The typical inadvertent contact occurs as maintenance personnel forcibly push or pull wires to access an adjacent electrical or mechanical component on the vehicle.

Many electrical and mechanical components of a vehicle are manufactured by outside suppliers and are shipped to assembly locations for subsequent incorporation into the vehicle. Thus, an outside supplier who carefully engineers and manufactures a component generally is not directly involved in the final assembly and installation of that component into the vehicle. It is quite possible that a precisely engineered and manufactured component could be installed improperly and lead to operational problems. Thus, the best engineered components are those that are simple to assemble and that cannot be assembled incorrectly.

Automobile manufacturers have recognized the potential problem of improperly assembled electrical components. As a result, many electrical components for vehicular applications require terminal position assurance (TPA) components to positively assure that the terminals are properly inserted into their respective housings. Most such prior art connectors have required a separate TPA component for each wire lead to the component. In many prior art electrical connectors for vehicular applications, the TPA component has complicated the assembly process.

Many electrical connectors for vehicular applications unavoidably require plural assemblable components, including at least one housing component, a plurality of wire seals and at least one TPA component. The fact that these components are manufactured at one location and shipped to another location for assembly creates the potential for inventory control problems. An incomplete inventory could result in a component being assembled without a seal or TPA component that could affect the performance of the assembled product.

It is desirable for the terminals of an electrical component to exert high normal contact forces. This objective is particularly important for vehicular applications where the electrical components are subjected to considerable vibrations and temperature changes. Many prior art terminals have been manufactured with relatively large dimensions in an effort to achieve consistently high normal forces. However, large terminals often inadvertently engage the wire seals during the assembly of the component, and damage either the seal or the terminal. A damaged seal or terminal may not perform its intended function. Alternatively, if the damage to the seal is noticed at the assembly location, the seal may be replaced, thereby contributing to the above referenced inventory control problems. In some situations, however, the damaged seal will merely be discarded, thereby yielding a potentially ineffective electrical component.

In view of the above, it is an object of the subject invention to provide an effective and easily assemblable electrical connector for fuel injectors and temperature sensors.

It is another object of the subject invention to provide a connector for a fuel injector and temperature sensor that can be substantially preassembled to avoid inventory control problems.

It is an additional object of the subject invention to provide an electrical connector for fuel injectors and temperature sensors that efficiently provides high normal contact forces against mating terminals without employing excessively large terminals.

It is a further object of the subject invention to provide an electrical connector for fuel injectors and temperature sensors that substantially prevents inadvertent withdrawal of the terminated leads therefrom.

Yet another object of the subject invention is to provide an electrical connector for fuel injectors and temperature sensors that positively ensures correct assembly of the components thereof.

Still an additional object of the subject invention is to provide an electrical connector for fuel injectors and temperature sensors where the components thereof can be lockingly retained in an initial preassembled condition and can subsequently be advanced and locked in a fully assembled condition.

Another object of the subject invention is to provide an electrical connector for fuel injectors and temperature sensors where the wire seals are securely protected from damage during component assembly and during use.

An additional object of the subject invention is to provide an electrical connector for fuel injectors and temperature sensors where the terminals cannot be misinserted into the housing or damaged by an attempt to misinsert.

A further object is to provide terminals that consistently provide high normal contact forces in a high vibration environment.

SUMMARY OF THE INVENTION

The subject invention is directed to an electrical connector, a housing assembly for an electrical connector and terminals, all of which may be used with an automotive fuel injector and/or the temperature sensor associated with an automotive fuel injector. In the typical application, the fuel injector or temperature sensor will comprise an open-ended housing having electrical terminals securely mounted therein. The terminals typically will be spade terminals that are substantially surrounded and protected by the housing of the fuel injector or temperature sensor.

The connector of the subject invention comprises an insulator housing formed from a nonconductive material. The insulator housing may be unitarily molded from a plastic material, and comprises a forward mating end and an opposed rearward wire receiving end. The forward mating end may be constructed for lockingly engaging the housing of the fuel injector or temperature sensor. The insulator housing comprises at least one through aperture defining terminal cavities for permitting the insertion of a pair of terminals from the rear of the insulator housing and for enabling subsequent mating of those terminals with spade terminals in the fuel injector or temperature sensor. The interior of the insulator housing comprises locking means for lockingly engaging the terminals inserted therein. The locking means may comprise deflectable locking levers that lockingly engage the terminals. The locking means may require the sequential insertion of the two terminals and may be constructed such that the insertion of the second terminal into the housing is contingent upon full and proper locking engagement of the first terminal therein.

The connector may further comprise a wire seal for sealing engagement about the wires, and a mating seal for sealing engagement with the housing of the fuel injector or temperature sensor.

The connector further comprises a terminal position assurance (TPA) component. The TPA component is constructed to assure proper positioning of both terminals. The TPA component may be lockable to the housing in alternate first and second positions. In particular, the TPA component may be locked to the housing in a first position for shipment to a final assembly location. In this initially assembled condition, the TPA component may protect and securely retain the wire seal in the housing. Thus, the housing may be shipped as part of a subassembly comprising the housing, the forward mating seal, the wire seal and the TPA component. The terminals and the wire leads connected thereto may then be inserted through the TPA component for locking engagement of the terminals in the housing. After proper seating of the terminals in the housing, the TPA component may be advanced to its fully seated condition for positively assuring the position of the terminals and for urging the wire seal into tighter sealing engagement about the wires.

The connector may further comprise a rear protective boot which is slidably mounted over the wires and is lockingly mountable to the rearward end of the housing. In particular, the boot may be lockingly mounted to locking wedges unitarily molded to the insulator housing intermediate the opposed forward and rearward ends thereof.

The terminals preferably are elastically supported dual cantilever beam spade-receiving terminals which provide four points of contact with each spade terminal with high normal contact forces. Terminals of this general type are described in co-pending patent application Ser. No. 255,001 which was filed on Oct. 6, 1988 and which is assigned to the assignee of the subject invention. The disclosure of the co-pending application Ser. No. 255,001 is incorporated herein by reference. The dual cantilever beam spade receiving terminals described herein are particularly advantageous for the subject fuel injector and temperature sensor interconnect in that they provide a small cross-sectional area that readily permits insertion of the terminals from the rearward end of the housing and through appropriate aperture means in both the TPA component and the wire seal. The forward mating ends of these terminals may define smaller cross-sectional dimensions than the rearward wire mounting ends of the terminals, thereby ensuring that the forward mating ends of the terminals can be passed through the wire seal without causing damage. The terminals may further be constructed to permit alternate 180° insertion positions with multiple locking in the housing. The locking interengagement between the housing and the terminals may provide for both a compressive locking component and a tension locking component with correspondingly high pullout forces. Preferably, the lock orientation and the configuration of the terminal cavities will positively prevent full seating of the TPA component unless both terminals are in their proper orientation and are fully seated and locked in the housing.

DETAILED DESCRIPTION OF THE PREFERRED EMBODIMENT

Figure 1:
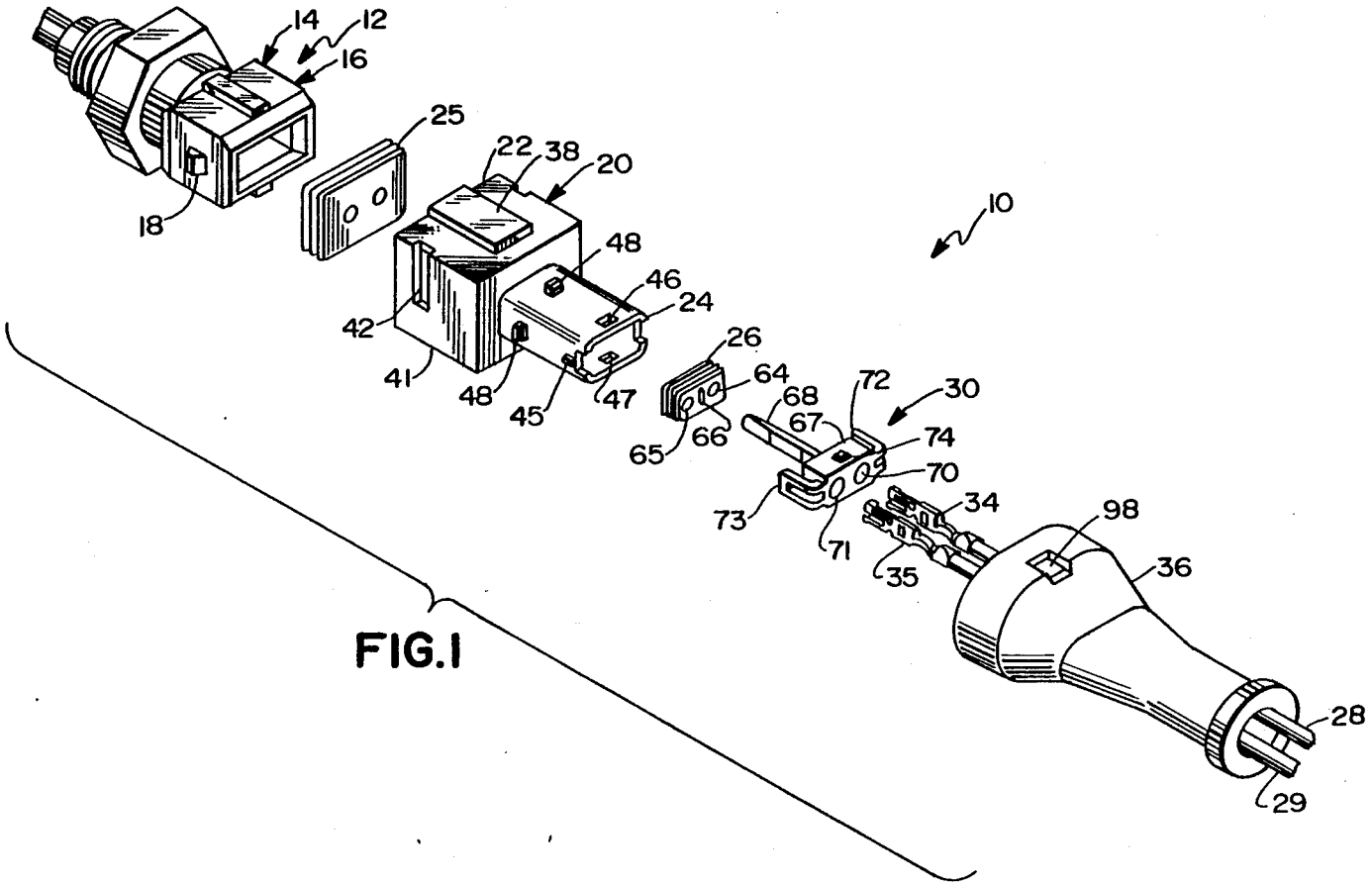
FIG. 1 is an exploded perspective view of the connector assembly of the subject invention.

The connector of the subject invention is identified generally by the numeral 10 in FIG. 1. The connector 10 is intended for mounting to an automotive fuel injector or temperature sensor which is identified generally by the numeral 12 in FIG. 1. The fuel injector or temperature sensor 12 to which the subject connector 10 is mountable comprises a housing 14 of generally opened rectangular configuration and defining a mating end 16. A pair of spade terminals (not shown) are mounted within the rectangular housing 14 and project toward the open mating end 16. A pair of locking wedges 18 project from the exterior of the housing 14. The electrical connector 10 of the subject invention is lockingly and sealingly engageable with the fuel injector or temperature sensor 12 with high quality electrical connection to the spade terminals therein.

The connector 10 illustrated in FIG. 1 comprises an insulator housing 20 which is unitarily molded from polyester or other suitable plastic material. The insulator housing 20 comprises a mating end 22 and an opposed wire mounting end 24. The mating end 22 of the insulator housing 20 defines the portion of the connector 10 that is lockingly engageable with the housing 14 of the fuel injector or temperature sensor 12. A mating seal 25 is securely receivable within the housing 20 from the mating end 22 thereof, and provides sealing protection for the electrically conductive components of the connector 10 and the fuel injector or temperature sensor 12. A wire seal 26 is receivable within the insulator housing 20 from the rear end 24 thereof and will sealingly engage the wires 28 and 29 extending into the connector 10. A terminal position assurance (TPA) wedge 30 is engageable with the rear end 24 of the insulator housing 20 in each of two alternate positions, as explained in greater detail below.

Figure 2:
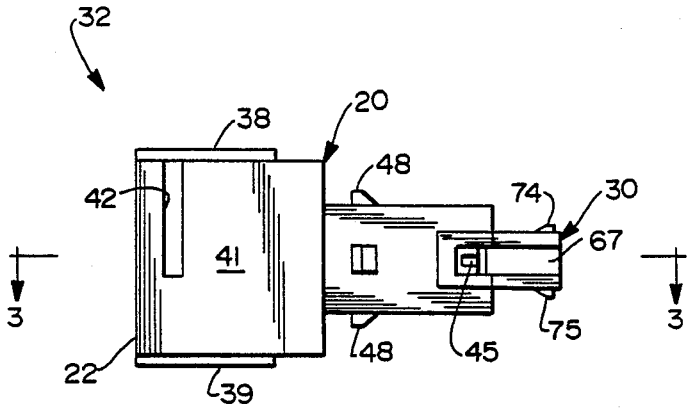
FIG. 2 is a side elevational view of a subassembly of the subject connector.
Figure 3:
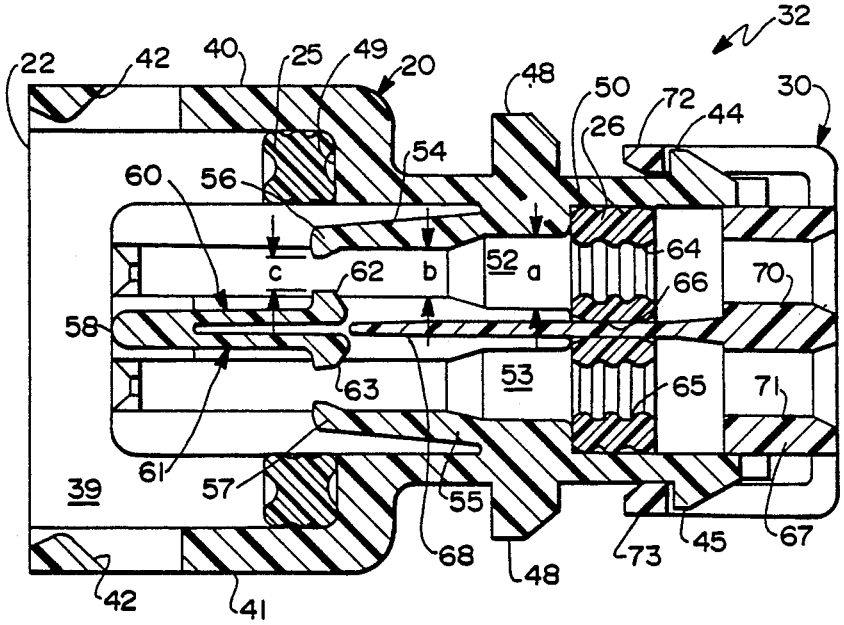
FIG. 3 is a cross-sectional view taken along line 3—3 in FIG. 2.

The mating seal 25 and the wire seal 26 can be inserted into the insulator housing 20, and the TPA wedge 30 can be engaged in a first position on the rear end 24 of the insulator housing 20 to define a subassembly 32 as depicted in FIGS. 2 and 3. The subassembly 32 can be assembled by the manufacturer of the connector 10 and shipped as a unit to a customer for subsequent complete assembly and installation onto a fuel injector or temperature sensor. The subassembly 32 substantially prevents inventory control problems and provides additional assurance of proper assembly of the connector 10.

The connector 10 further comprises terminals 34 and 35 which are crimped to the wires 28 and 29 as shown in FIG. 1. A boot 36 unitarily formed from an elastomeric material such as Nitrile is engaged over the wires 28 and 29 and is engageable with the rear end 24 of the insulator housing 20 in the fully assembled condition of the connector 10. The connector 10 can be assembled by sequentially inserting the terminals 34 and 35 through the TPA wedge 30, through the wire seal 26 and into the insulator housing 20 as explained in detail herein. The TPA wedge 30 is urged into its second position relative to the rear end 24 of the insulator housing 20 after the terminals 34 and 35 have been properly seated. The TPA wedge 30 positively assures that the terminals 34 and 35 are fully seated within the insulator housing 20. Assembly of the connector 10 is completed by urging the boot 36 into locking engagement with the insulator housing 20.

Turning to FIGS. 2 and 3, the insulator housing 20 is of unitary molded construction and of generally rectangular external configuration, with opposed top and bottom 38 and 39 and opposed sides 40 and 41. The terms top and bottom are used herein for identification purposes only, and do not imply a required gravitational orientation. The mating end 22 of the insulator housing 20 is configured to telescopingly slide over the mating end 16 of the housing 14 on the fuel injector or temperature sensor 12 depicted in FIG. 1. Locking apertures 42 are unitarily molded into the insulator housing 20 generally adjacent the mating end 22 thereof for locking engagement with the locking wedges 18 on the housing 14 of the fuel injector or temperature sensor 12.

The insulator housing 20 further comprises a pair of first TPA locks 44, 45 for lockingly engaging the TPA wedge 30 in a first position. The first TPA locks 44, 45 are of generally wedge shape and are dimensioned to lockingly receive deflectable latches on the TPA wedge 30 as explained further below. The insulator housing 20 further comprises a pair of second TPA locks 46, 47 for lockingly engaging appropriate structures on the TPA wedge 30 in a second relative position of the TPA wedge 30 on the insulator housing 20. The exterior of the insulator housing 20 further comprises a plurality of boot locks 48 intermediate the opposed ends 22 and 24 of the insulator housing 20. The boot locks 48 also are of generally wedge shape and are dimensioned to engage appropriate locking structures on the boot 36.

The interior of the insulator housing 20 is shown most clearly in FIG. 3. In particular, the interior of the insulator housing 20 comprises a forwardly facing mating shoulder 49 and a rearwardly facing shoulder 50 which is configured to define terminal cavities 52 and 53 having rear entrances of cross section dimension "a" corresponding to the cross section of the terminated wire 28, 29 and terminal 34, 35.

Forwardly directed deflectable locking levers 54 and 55 are cantilevered from portions of the shoulder 50 adjacent the sides 40 and 41 of the insulator housing 20 and are configured to define a minor width "b" for the terminal cavities 52 and 53. The forwardly directed deflectable locking levers 54 and 55 terminate at their deflectable forward ends in locking fingers 56 and 57 respectively which are disposed and dimensioned to extend into terminal cavities 52 and 53 to lockingly engage the terminals 34 and 35 as explained below. The rearwardly facing cam surfaces of the locking fingers 56, 57 are acutely aligned to the longitudinal axis of the housing 20. However, the forwardly facing locking surfaces of the locking fingers 56, 57 are approximately orthogonal to the longitudinal axis.

The interior of the insulator housing 20 further comprises a support 58 intermediate the mating shoulder 49 and the forward mating end 22 and extending between the top and bottom 38 and 39 of the housing 20. A pair of rearwardly extending deflectable locking levers 60 and 61 are cantilevered from the support 58. The locking levers 60 and 61 extend in slightly spaced generally parallel back-to-back relationship from the support 58 and toward the rear 24 of the insulator housing 20. The rearwardmost portions of the rearwardly extending deflectable locking levers 60 and 61 define locking fingers 62 and 63 respectively which extend into the terminal cavities 52 and 53 and are generally in line with the locking fingers 56 and 57 of the levers 54 and 55 respectively. The distance "c" between the locking fingers 56 and 62 or 57 and 63 prior to deflection is selected to enable locking engagement of the terminals 34 and 35 as explained herein. The rearwardly facing cam surfaces of the locking fingers 62, 63 are acutely aligned to the longitudinal axis of the housing 20, while the forwardly facing locking surfaces are generally orthogonal to the longitudinal axis.

The subassembly 32 depicted in FIGS. 2 and 3 is initially assembled by inserting the mating seal 25 from the forward mating end 22 of the insulator housing 20. The mating seal 25 is dimensioned to seat against the mating shoulder 49 and will be engaged by the mating end 16 of the fuel injector or temperature sensor 12 upon mating as illustrated below.

The wire seal 26 is insertable into the insulator housing 20 from the rear 24 thereof to seat against the shoulder 50. The wire seal 26 is formed from an elastomeric material and includes apertures 64 and 65 extending therethrough in alignment with the terminal cavities 52 and 53. The apertures 64 and 65 are dimensioned to permit the passage of at least portions of the terminals 34 and 35 therethrough, but will tightly seal against the wires 28 and 29. The wire seal 26 further includes a central aperture 66 for receiving a portion of the TPA component 30.

The TPA component 30 is of unitary molded plastic construction and comprises a generally rectangular body 67 dimensioned to be slidably inserted into the rearward end 24 of the insulator housing 20. A tapered wedge 68 extends centrally from the forward end of the body 67 and is dimensioned to be slidably inserted through the aperture 66 in the wire seal 26. Additionally, the wedge 68 is dimensioned to be inserted intermediate the rearwardly extending deflectable locking levers 60 and 61 in the insulator housing 20. The TPA wedge 30 further comprises a pair of apertures 70 and 71 extending through the body 67 and alignable with the apertures 64 and 65 in the wire seal 26. The apertures 70 and 71 are dimensioned to receive at least portions of the terminals 34 and 35 as explained further below.

Deflectable latches 72 and 73 are cantilevered from opposed sides of the body 67 of the TPA wedge 30 and extend forwardly therefrom. The latches 72 and 73 are configured to lockingly engage the first TPA locks 44, 45 on the insulator housing 20 to mount the TPA wedge 30 in a first position relative to the insulator housing 20. The body 67 further comprises locking wedges 74, 75 which are disposed to engage the second TPA locks 46, 47 on the insulator housing 20 in a second position of the TPA wedge 30 relative to the insulator housing 20.

The subassembly 32 comprising the insulator housing 20, the mating seal 25, the wire seal 26 and the TPA wedge 30 are assembled as shown most clearly in FIG. 3. In particular, the mating seal 25 is inserted into the insulator housing 20 from the front mating end 22 therof to be seated against the mating shoulder 49. The wire seal 26 is inserted from the rear 24 of the insulator housing 20 to be seated against the shoulder 50. The TPA wedge 30 then is advanced into the rear end 24 of the insulator housing 20 such that the wedge 68 passes through the aperture 66 in the wire seal 26. Continued advancement of the TPA wedge 30 toward the insulator housing 20 will cause the latches 72 and 73 to be deflected outwardly by the engagement with the first TPA locks 44 and 45 respectively on the insulator housing 20. Sufficient movement of the TPA wedge 30 toward the insulator housing 20 will cause the deflectable latches 72 and 73 to resiliently return to their unbiased condition for engagement with the first TPA locks 44 and 45 to define a first relative position between the TPA wedge 30 and the insulator housing 20. The subassembly 32 as depicted in FIG. 3 protects both the mating seal 25 and the wire seal 26. The subassembly 32 substantially avoids inventory control problems and can be shipped from the manufacturer of the component 10 for subsequent final assembly at another location as explained further below.

Figure 4:
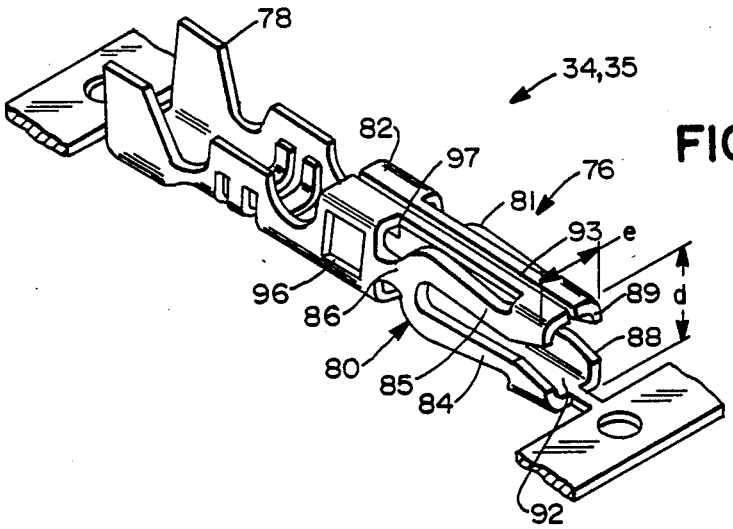
FIG. 4 is a perspective view of a terminal for incorporation into the connector of the subject invention.
Figure 5:
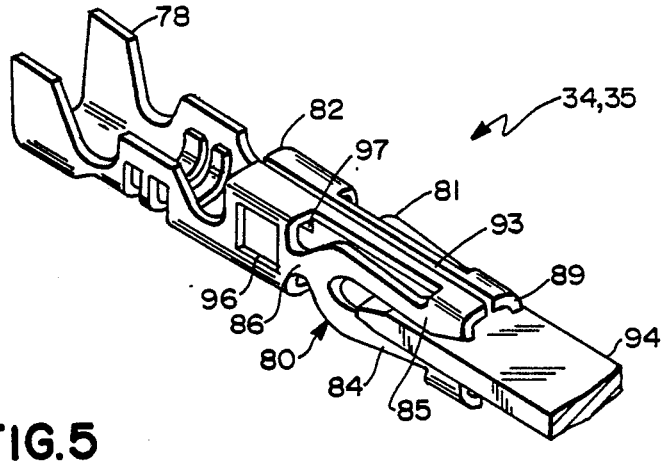
FIG. 5 is a perspective view of the terminal shown in FIG. 4 with a spade terminal mated thereto.
Figure 6:
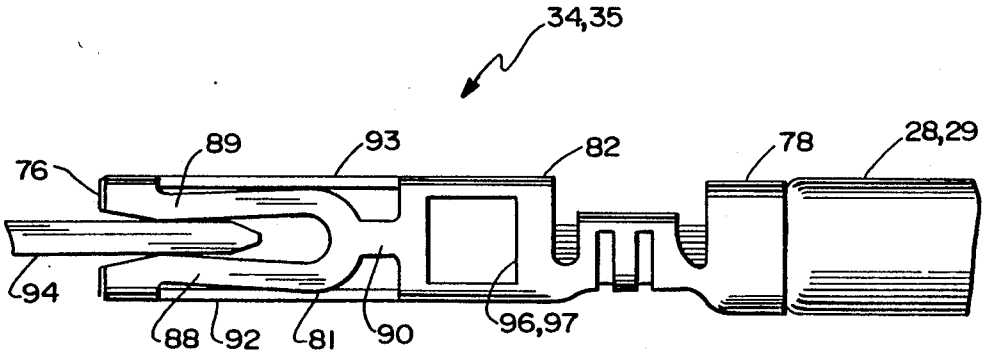
FIG. 6 is a side elevational view of the mated terminals shown in FIG. 5.

The terminals 34, 35 are depicted in greater detail in FIGS. 4,5 and 6. A large plurality of terminals 34 and 35 can be stamped and formed from a unitary strip of metal, such as beryllium copper, to define either one or two carrier strips for efficiently delivering the terminals 34, 35 to a terminating press apparatus at which the terminals 34, 35 are crimped to wires 28, 29. The terminals 34, 35 comprise a forward mating end 76 and an opposed wire mounting end 78 which is crimpable to the respective wire 28, 29. The mating end 76 of the terminals 34, 35 is of generally rectangular cross section and defines orthogonal major and minor cross-sectional dimensions "d" and "e" respectively. The dimensions "d" and "e" are approximately equal or slightly less than the major and minor dimensions of the terminal cavities 52 and 53 in the housing 20 to ensure proper orientation of the terminals 34 and 35 as explained below.

The mating end 76 of each terminal 34 or 35 comprises a pair of substantially parallel stamped tuning fork contact structures 80 and 81 which extend from a central rectangular tubular support 82. The tuning fork contact structure 80 comprises a pair of deflectable contact beams 84 and 85 which are disposed in spaced generally parallel relationship to one another and extend unitarily from a root 86 which in turn extends from the support 82. The tuning fork contact structure 81 similarly comprises a pair of opposed deflectable contact beams 88 and 89 which extend unitarily from a root 90 connected unitarily with the support 82. The gap between the contact beams 84 and 85 of the tuning fork contact structure 80 and between the contact beams 88 and 89 on the tuning fork contact structure 81 can be precisely controlled in view of the stamping formation of the tuning fork contact structures 80 and 81 as opposed to forming operations which are employed on many terminal constructions. Thus, the contact forces to be developed by the contact beams 84, 85, 88 and 89 can be precisely controlled and will remain consistently high even after plural mating cycles. High contact forces are further ensured by the provision of straps 92 and 93. More particularly, the strap 92 connects the free ends of the contact beams 84 and 88 to one another and to the rectangular tubular support 82 from which the tuning fork contact structures 80 and 81 extend. The strap 93 similarly connects the mating ends of the contact beams 85 and 89 to the rectangular tubular support 82. The strap 93 does not unitarily connect the mating ends of the contact beams 85 and 89 to one another, but rather comprises a longitudinal seam. However, the opposed halves of the strap 93 will function as a single structural support in view of the illustrated formation and in view of tin plating that may be applied to the mating end of the terminal 34, 35. The straps 92 and 93 are operative to yield higher normal contact forces by the contact beams 84, 85, 88 and 89, and yield even greater consistency after a large number of mating cycles. Other advantages and other possible configurations for the terminals 34, 35 are described in co-pending application Ser. No. 255,001, the disclosure of which has been incorporated herein by reference.

The terminals 34, 35 are intended for mating with a spade terminal 94 as shown in FIG. 5 having a cross section of approximately 0.032 inch by 0.116 inch. The terminals 34, 35 achieve mating forces and normal contact forces substantially equal to the force of a typical fast-on terminal but define a cross section of approximately only one third the size of a typical fast-on for this application. The small size achieves several very significant advantages, including lower material costs and smaller overall space requirements. Furthermore, the small size enables efficient insertion of the terminals 34, 35 into the rearward end of the subassembly 32 as explained further below. Additionally, the box shape cross section at the mating end 76 of the terminals 34, 35 defines a more robust construction that will not be damaged during insertion and that will not damage the wire seal 26 as illustrated in FIGS. 1 and 3 above. Thus, this configuration of the terminals 34, 35 enables the subassembly 32 to be shipped to a location for final assembly without fear that the final assembly of the terminals 34, 35 into the subassembly 32 will damage the wires seals 26 that had previously been incorporated into the subassembly 32.

The rectangular tubular support portion 82 of the terminals 34, 35 defines a pair of opposed generally rectangular locking apertures 96 and 97 therein. The locking apertures enable positive locking engagement of the terminals 34, 35 in the insulator housing 20 and further ensure full seating and proper alignment of the terminals 34, 35 as explained below. The locking apertures and 97 are directly opposite one another, thereby enabling 180° reversal of the terminals 34, 35.

Figure 7:
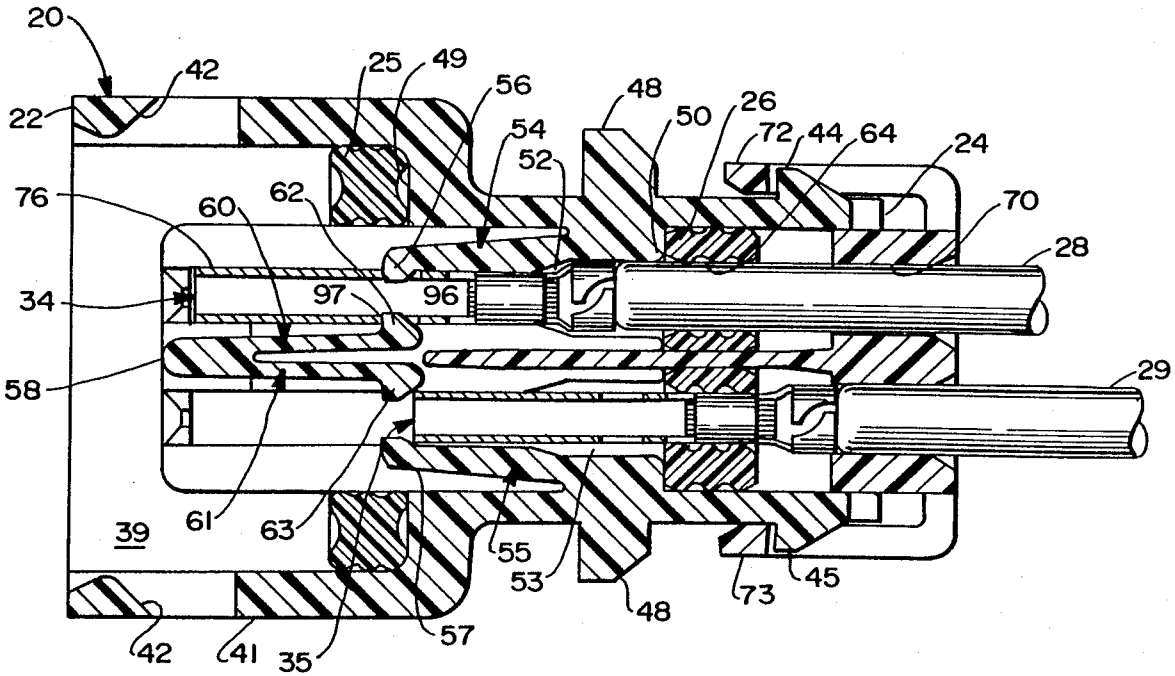
FIG. 7 is a cross-sectional view similar to FIG. 3 in a later stage of assembly.
Figure 8:
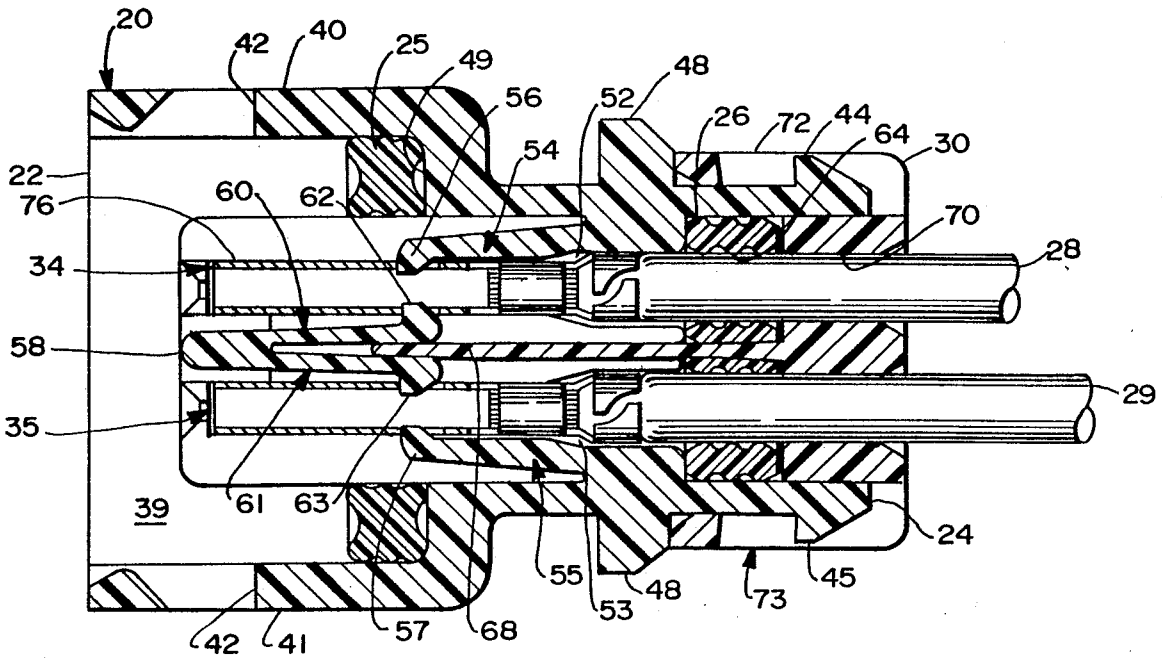
FIG. 8 is a cross-sectional view similar to FIG. 7 showing the connector in a fully assembled condition.

The assembly of the connector 10 is completed by sequentially inserting the terminals 34 and 35 into the subassembly 32 as depicted in FIGS. 7 and 8. In particular, the terminal 34, which is electrically and mechanically mounted to the wire 28 is inserted through the aperture 70 in the TPA wedge 30 and further through the aperture 64 in the wire seal 26. The relatively small dimensions of the mating end 76 of the terminal 34 enable the terminal 34 to be passed through the aperture 64 in the wire seal 26 without damage to either the wire seal 26 or the terminal 34. The terminal 34 is aligned such that the major axis of the generally rectangular cross-sectioned terminal 34 is aligned parallel to the major axis of the terminal cavity 52. An improper alignment of the major axis of the terminal 34 would prevent the terminal 34 from being fully inserted into the terminal cavity 52 of the insulator housing 20. However, the robust construction resulting from the box-like configuration of the terminal 34 will substantially prevent any damage to the terminal 34 if an improper insertion is attempted.

The mating end 76 of the terminal 34 will be urged against the acutely aligned rearwardly facing cam surfaces of the locking fingers 56 and 62 on the locking levers 54 and 60 respectively. The camming action developed between the mating end 76 of the terminal 34 and the rearwardly facing cam surfaces of the locking fingers 56 and 62 will cause an outward deflection of the locking levers 54 and 60 respectively. The approximate alignment of the terminal 34 enabled by the aperture 70 in the TPA wedge 30 will substantially ensure proper alignment of the terminal 34 with the rearwardly facing cam surfaces on the locking fingers 56 and 62, thereby preventing overstress of the locking levers 54 and 60. The protection afforded by the external walls of the insulator housing 20 further prevents overstress of the locking levers 54 and 60.

Upon sufficient insertion of the terminal 34 into the terminal cavity 52 of the insulator housing 20, the locking fingers 56 and 60 will align respectively with the locking apertures 96 and 97 of the terminal 34. The locking levers 54 and 60 will then resiliently return to their unbiased condition such that the forwardly facing surfaces of the locking fingers 56 and 62 will securely engage the respective locking apertures 96 and 97 to positively prevent rearward withdrawal of the terminal 34 from the insulating housing 20. With reference to FIG. 7, it will be noted that any rearward force exerted on the wire 28 and the terminal 34 will cause the locking lever 54 to be in compression, while simultaneously causing the locking lever 60 to be in tension. The combined compressive and tensile reaction forces result in an extremely high rearward force to effect component failure and/or rearward pullout.

After the terminal 34 has been properly seated as shown in FIG. 7, the terminal 35 is inserted in substantially the same manner. FIG. 8 depicts the terminals 34 and 35 in their fully inserted and locked orientation. In particular, the locking fingers 57 and 63 of the locking levers 55 and 61 respectively will initially deflect and then resiliently return to an unbiased condition to engage the locking apertures 96 and 97 in the terminal 35.

Figure 9:
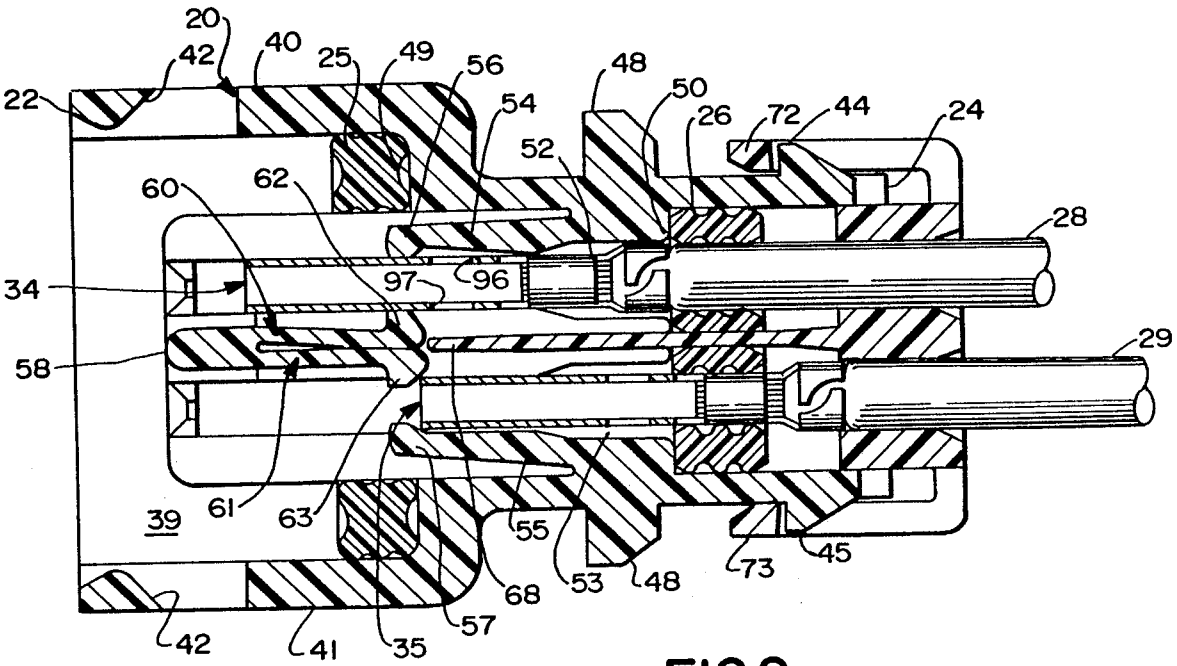
FIG. 9 is a cross-sectional view similar to FIG. 7 showing an attempt to misassemble the connector.

The orientation of the locking levers 60 and 61 prevents insertion of the terminal 35 prior to complete insertion of the terminal 34. In particular, with reference to FIG. 9, the terminal 34 is depicted in an orientation prior to full insertion. In this position, as shown in FIG. 9, the locking fingers 56 and 62 are not engaged with the locking apertures 96 and 97 of the terminal 34. Consequently, the locking levers 54 and 60 remain in a deflected condition with the locking lever 60 abutting the locking lever 61. An attempt to insert the terminal 35 will be impeded by the inability of the locking lever 61 to deflect out of the terminal cavity 53. In particular, forces exerted by the mating end of the terminal 35 against the rearwardly facing cam surface of the locking finger 63 will cause the locking lever 61 to be urged tightly against the deflected locking lever 60. The return of the locking lever 60 to its unbiased condition is prevented by contact between the locking finger 62 thereof and the terminal 34. Thus, the insertion of the terminal 35 functions as a terminal position assurance (TPA) for terminal 34 even prior to the final seating of the TPA wedge 30.

Turning back to FIG. 8, after the terminals 34 and 35 have been fully seated, the TPA wedge 30 is advanced into its second relative position on the insulator housing 20. In this second relative position, the locking wedges 74 and 75 of the TPA wedge 30 will engage with the second TPA locks 46 and 47 on the insulator housing 20. As the locking wedges 74 and 75 engage the second TPA locks 46 and 47, the wedge 68 will be urged intermediate the locking levers 60 and 61. If either terminal 34 or 35 is not fully seated in the insulator housing 20, the locking lever 60 or 61 will be deflected toward the center of the insulator housing 20, generally as shown in FIG. 9, thereby preventing movement of the wedge 68 between the locking levers 60 and 61, and further preventing engagement between the locking wedges 74 and 75 and the second TPA locks 46 and 47. Thus, the ability of the locking wedges 74 and 75 on the TPA wedge 30 to engage the second TPA locks 46 and 47 respectively provides positive assurance that the terminals 34 and 35 are in their proper seated condition in the insulator housing 20.

The final assembly step of the connector 10 merely requires the axial advancement of the boot 36 over the rear end 24 of the insulator housing 20 such that the locking apertures 98 on the boot 36 engage the locking wedges 48 on the insulator housing 20.

Figure 10:
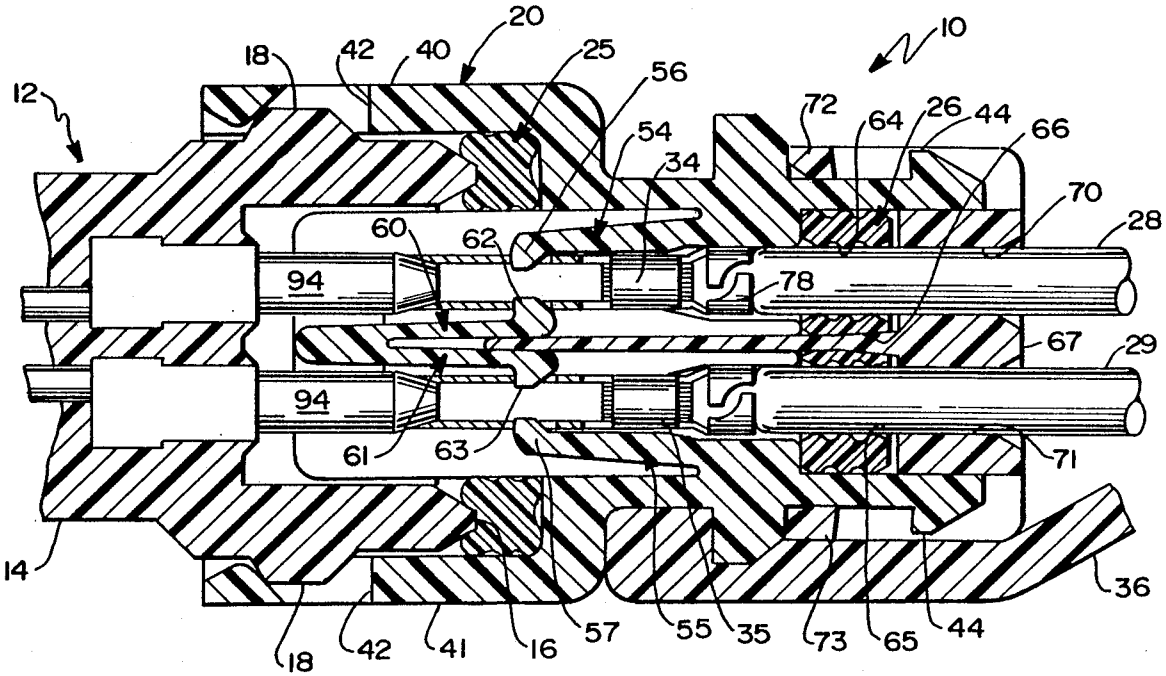
FIG. 10 is a cross-sectional view similar to FIG. 8 but showing the connector mated with a fuel injector or temperature sensor.

The assembled connector 10 is employed by axially moving the connector 10 into engagement with the fuel injector or temperature sensor 12, as shown in FIG. 10.

In this mated condition, the mating end 16 of the housing 14 for the fuel injector or temperature sensor 12 is urged into sealing engagement with the mating seal 25. Additionally, the locking wedges 18 on the housing 14 will cause a small deflection adjacent the mating end 22 of the insulator housing 20, enabling the locking wedges 18 to pass into locking engagement with the locking apertures 42 of the insulator housing 20. The initial telescoping engagement of the housing 14 with the insulator housing 20 will guide the spade terminals 94 into mating contact with the terminals 34, 35. Each spade terminal 94 will be urged between the contact beams of the pair of tuning fork contact structures 80 and 82 such that one planar side of each spade terminal 94 is contacted by contact beams 84 and 88, while the opposed planar side of each spade terminal 94 will be contacted by the contact beams 85 and 89. As noted above, the stamping of each tuning fork contact structure 80 and 82 enables reliable spacing between the opposed pairs of contact beams 84, 85 and 88, 89, such that high normal contact forces can reliably be developed against the spade terminals 94. Furthermore, four points of contact will exist against each spade terminal 94.

Figure 11:
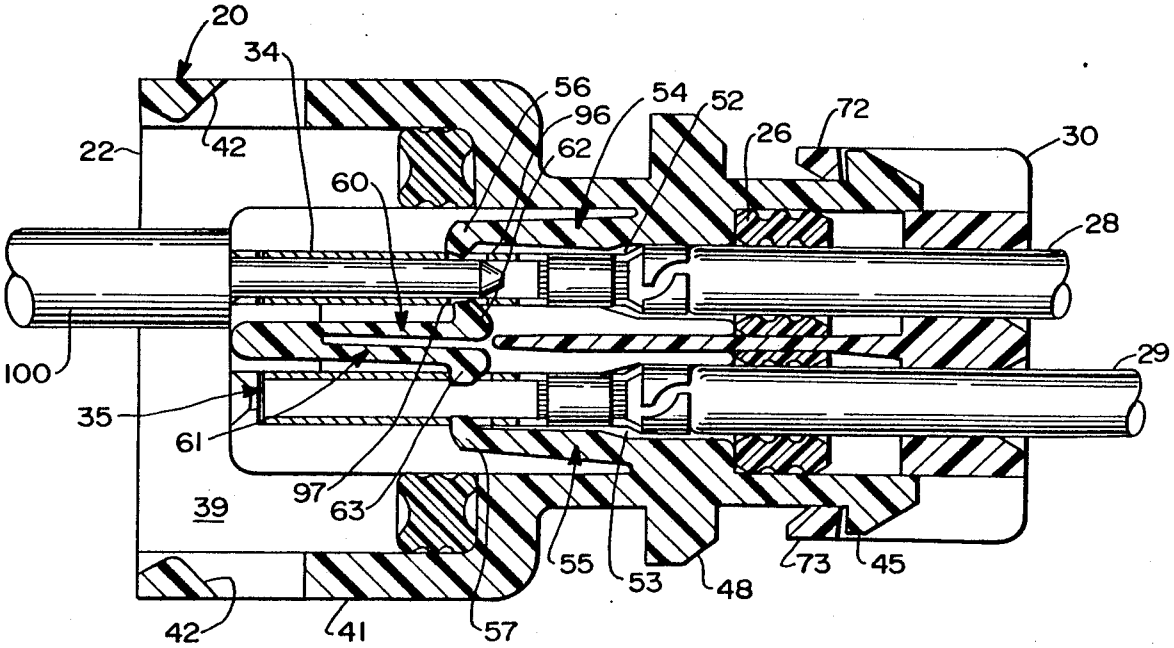
FIG. 11 is a cross-sectional view showing the use of a probe to permit selective removal of terminals from their locked position in the housing.

In certain situations, it may be desirable to disassemble the connector 10. The disassembly can be achieved by urging a probe 100 into the mating end of the connector 10 as shown in FIG. 11. The probe 100 includes a tapered leading end and is operative to deflect the locking levers 54 and 60 away from one another and out of engagement with the locking apertures 92 and 93. The disassembly sequence would be to first remove the boot 36. The TPA wedge 30 would then be removed by appropriately deflecting the extreme rear end 24 of the insulator housing 20. With the TPA wedge 30 removed to at least its first relative position on the insulator housing 20, the probe 100 is inserted into the mating end of the connector 10 causing the locking levers 54 and 60 to be deflected and enabling the terminal 34 and wire 28 to be removed rearwardly. The probe 100 could then similarly be employed to disengage the terminal 35.

In summary, a connector assembly is provided for a fuel injector or temperature sensor. The connector assembly comprises an insulator housing having a plurality of locking levers deflectably mounted therein for lockingly engaging terminals in the insulator housing. A TPA wedge is mountable to the rearward end of the insulator housing in alternate first and second positions. The first position of the TPA wedge enables the insulator housing and the TPA wedge, as well as certain seals, to be shipped as a subassembly for subsequent final assembly. Terminals and the wires to which the terminals are connected are then insertable into the subassembly through the TPA wedge. Sufficient insertion of the terminals into the insulator housing achieves locking engagement between the levers in the housing and the terminals. The levers preferably are disposed such that the insertion of the second terminal is predicated upon a full and proper seating of the first terminal. The TPA wedge can then be advanced from its first position to its second position relative to the housing for positively assuring proper seating of both terminals therein.

While the invention has been described with respect to a preferred embodiment, it is apparent that various changes can be made without departing from the scope of the invention as defined by the appended claims. In particular, various elements of the preferred connector assembly can be used independently. Furthermore, the locking components can be varied substantially from the specific illustrated locking constructions described and illustrated above.

We claim:

1. An electrical connector including an insulator housing having a forward mating end and an opposed rearward wire mounting end, at least first and second terminal receiving cavities and a locking means for retaining terminals in the respective cavities, the improvement in the locking means comprising:

forwardly extending deflectable locking levers cantilevered from said insulator housing and extending into each said terminal cavity for lockingly engaging the terminal inserted therein, each said forwardly extending deflectable locking lever including a rearwardly facing cam surface aligned to cause said forwardly extending deflectable locking lever to be deflected by the insertion of the terminal into the mounting end of the insulator housing;

rearwardly extending deflectable locking levers cantilevered from said insulator housing and extending into each said terminal cavity for lockingly engaging the terminal inserted therein, each said rearwardly extending deflectable locking lever including a rearwardly facing cam surface aligned to cause said rearwardly extending deflectable locking lever to be deflected by the insertion of the terminal into the mounting end of the insulator housing;

one said locking lever of said first terminal cavity being disposed in spaced relationship to one said locking lever of said second terminal cavity in undeflected conditions of said locking levers; and a TPA component urgeable into a position between the spaced apart locking levers of said first and second terminal cavities respectively, whereby an inability to urge said TPA component intermediate the spaced apart locking levers is indicative of at least one of said locking levers being in a deflected condition corresponding to an improper insertion of one of said terminals in said insulator housing; and whereby the forwardly and rearwardly extending locking levers alternately exert compressive and tensile forcers on the terminals mounted in said insulator housing for securely positioning the terminal in the housing and preventing unintended withdrawal thereof.

2. A connector as in claim 1 wherein the locking levers comprise forwardly facing locking surfaces for lockingly engaging the terminal and preventing rearward withdrawal of the terminal from the insulator housing.

3. A connector as in claim 1 wherein the locking levers are configured such that the deflection of at least one locking lever in the first terminal cavity prevents deflection of at least one locking lever in the second terminal cavity, whereby an incomplete insertion of said first terminal into said first terminal cavity causes the locking levers thereof to remain in a deflected condition and prevents the deflection of at least one locking lever in the second terminal cavity thereby preventing insertion of the second terminal into the second terminal cavity.

4. A connector as in claim 1 wherein said TPA component comprises means for locking engagement to said insulator housing.

5. An electrical connector assembly including an insulator housing having a forward mating end, a rearward terminal receiving end and first and second terminal cavities extending between the forward and rearward ends for receiving first and second terminals respectively, locking means for lockingly engaging the first and second terminals respectively upon complete insertion of said terminals into said first and second terminal cavities, and a TPA component for assuring complete insertion of said terminals in said cavities, the improvement in said electrical connector assembly comprising:

said locking means including first and second rearwardly extending deflectable locking levers cantilevered into said first and second terminal cavities respectively and being spaced from one another in their undeflected conditions, said first and second rearwardly extending deflectable locking levers being configured to deflect toward one another during insertion of the respective first and second terminals into the rearward end of the insulator housing and returning to their undeflected condition upon complete insertion of the respective first and second terminals for securely locking the terminals in the insulator housing, such that the deflection of said first rearwardly extending deflectable locking lever corresponding to incomplete insertion of the first terminal prevents deflection of the second locking lever and thereby preventing insertion of the second terminal;

first and second mounting means for mounting said TPA component in alternate respective first and second positions on the rearward terminal receiving end of said insulator housing;

first and second terminal alignment apertures in the TPA component for aligning the first and second terminals with the respective first and second terminal cavities of said insulator housing when said TPA component is mounted in the first position; and assurance means extending forwardly from the TPA component and in alignment with the space between the rearwardly extending deflectable locking levers, said assurance means being disposed between the rearwardly extending locking levers for assuring locking engagement of said rearwardly extending locking levers with the first and second terminals when said TPA component is mounted in the second position, whereby an inability to insert the second terminal is indicative of the first terminal being incompletely inserted, and whereby an inability to mount said TPA component in the second position on said insulator hosing is indicative of at least the second of said terminals in said insulator housing being incompletely inserted.

6. A connector housing assembly as in claim 5 wherein said deflectable levers comprise terminal engagement means for locking engagement with the terminals positioned in said terminal cavities of said insulator housing.

7. A connector housing assembly as in claim 6 wherein the terminal engagement means on said deflectable levers comprise locking fingers disposed respectively on the deflectable levers, each said locking finger comprising a cam surface engageable by one of said terminals for deflecting the associated locking lever during insertion of said terminal into said insulator housing.

8. A connector housing assembly as in claim 5 further comprising a wire seal mountable in said housing from the rear end thereof and intermediate said housing and said TPA component, said wire seal comprising a pair of wire apertures generally aligned with the terminal cavities of said insulator housing.

9. A connector housing assembly as in claim 8 wherein said wire seal comprises aperture means for permitting passage of the assurance means therethrough.

10. A connector housing assembly as in claim 8 further comprising a mating seal mounted to said insulator housing generally adjacent the forward end thereof.

11. An electrical connector including a unitarily molded insulator housing having a forward mating end, a rear wire mounting end and first and second terminal cavities extending between the forward and rear ends of said insulator housing, first and second terminals dimensioned for slidable insertion into the respective first and second terminal cavities of said insulator housing and locking means for retaining said terminals within their respective cavities, the improvement in said locking means comprising:

said housing including first and second forwardly extending deflectable locking levers cantilevered into the respective first and second terminal cavities, said forwardly extending locking levers having rearwardly facing cam surfaces, first and second rearwardly extending deflectable locking levers cantilevered into the respective first and second terminal cavities and having rearwardly facing cam surfaces, said rearwardly extending locking levers being in spaced relationship in their respective undeflected conditions, but being deflectable into contact with one another; and said terminals slidably engaging the cam surfaces of said forwardly and rearwardly extending locking levers cantilevered into said terminal cavities, each said terminal including first and second locking apertures dimensioned for engaging the respective first and second forwardly and rearwardly extending locking levers;

whereby the slidable insertion of said terminals into said terminal cavities and against the cam surfaces causes said forwardly and rearwardly extending locking levers to initially deflect and to subsequently engage the locking apertures in said terminals; and whereby incomplete insertion of either of said terminals into the associated terminal cavity maintains the associated rearwardly directed locking lever in a deflected condition abutting the other rearwardly directed locking lever and preventing insertion of the other terminal into the associated terminal cavity of said insulator housing.

12. A connector as in claim 11 further comprising a TPA component lockable with the rear end of said insulator housing, said TPA component comprising a wedge dimensioned for insertion between the rearwardly directed deflectable levers in the undeflected condition of said levers, whereby the defection of either of said rearwardly directed locking levers prevents insertion of the wedge of said TPA component intermediate the rearwardly directed locking levers of said insulator housing, thereby, indicating improper positioning of at least one of said terminals in said insulator housing.

13. A connector as in claim 12 wherein said TPA component comprises a pair of apertures aligned respectively with the terminal cavities of said insulator housing, said terminals being mounted to wires extending through the apertures in the TPA component and into the terminal cavities of said insulator housing.

14. A connector as in claim 13 further comprising first and second mounting means for mounting said TPA component in alternate first and second positions relative to said insulator housing, said first mounting means being disposed to position said wedge of said TPA component in spaced relationship to the rearwardly extending locking levers, and said second mounting means being disposed to position said wedge of said TPA component intermediate the rearwardly extending locking levers of said insulator housing.

15. A connector as in claim 13 further comprising a wire seal mounted in the rear end of said insulator housing and intermediate said insulator housing and said TPA component, said wire seal comprising a pair of aperture means aligned with the terminal cavities of said insulator housing and surrounding the wire mounted to said terminals, said wire seal further comprising aperture means for permitting passage of the wedge therethrough.

16. A connector as in claim 11 wherein each of said terminals comprises a wire mounting end, a mating end and a generally tubular support intermediate the wire mounting and the mating end, said tubular support comprising the locking apertures for engaging the locking levers of said insulator housing.

17. A connector as in claim 16 wherein the locking levers comprise locking fingers generally aligned with one another and wherein the tubular support of each said terminal is of generally rectangular tubular configuration with an opposed pair of support walls and an opposed pair of connecting walls, said locking apertures extending through the respective supporting walls of said rectangular tubular support of each said terminal.

18. A connector as in claim 17 wherein each said terminal further comprises a pair of stamped tuning fork contact structures, each said tuning fork contact structure comprising a root extending unitarily from the respective support walls of said rectangular tubular support and a pair of cantilevered deflectable contact beams extending unitarily from said root, support straps extending unitarily from each said deflectable contact beam to one of said connecting walls of said rectangular tubular support.

19. An electrical connector including an insulator housing having a forward mating end and an opposed rearward wire mounting end, first and second terminal receiving cavities and a locking means for retaining the terminals in the cavities, the improvement in the locking means comprising:

a forwardly extending deflectable locking lever cantilevered from said insulator housing and extending into each said terminal cavity for lockingly engaging a terminal inserted therein; and a rearwardly extending deflectable locking lever cantilevered from said insulator housing and extending into each said terminal cavity for lockingly engaging said terminal;

said deflectable locking levers each comprising a rearwardly facing cam surface aligned to cause said locking levers to be deflected by the insertion of the respective terminal into said insulator housing;

the locking levers being configured such that the deflection of at least one locking lever in the first terminal cavity prevents deflection of at least one locking lever in the second terminal cavity;

whereby an incomplete insertion of said first terminal into said first terminal cavity causes the locking levers thereof to remain in a deflected condition and prevents the deflection of at least one locking lever in the second terminal cavity thereby preventing insertion of the second terminal into the second terminal cavity; and whereby the forwardly and rearwardly extending locking levers alternately exert compressive and tensile forces on a terminal mounted in said insulator housing for securely positioning the terminal in the housing and preventing unintended withdrawal thereof.

* * * * *